United States Patent [19]

Pepe

[11] 4,100,974

[45] Jul. 18, 1978

[54] MACHINE SUSPENDED FROM A CRANE OR SIMILAR DEVICE FOR DRIVING AND EXTRACTING PILING AND THE LIKE

[76] Inventor: Charles R. Pepe, Old Quarry Rd., Alpine, N.J. 07620

[21] Appl. No.: 757,206

[22] Filed: Jan. 6, 1977

[51] Int. Cl.[2] ..... E02D 7/06

[52] U.S. Cl. ..... 173/49; 173/91; 404/117

[58] Field of Search ..... 74/61, 87; 173/47, 49, 173/91; 404/102, 117

[56] References Cited

U.S. PATENT DOCUMENTS

| | | | |
|---|---|---|---|
| 2,483,318 | 9/1949 | Lazan | 74/61 |
| 2,728,277 | 12/1955 | McRae | 404/117 |
| 2,743,585 | 5/1956 | Berthet et al. | 173/49 X |
| 2,831,353 | 4/1958 | Ongaro | 74/61 |
| 3,737,244 | 6/1973 | Wilson | 404/117 |
| 3,814,532 | 6/1974 | Barrett et al. | 404/117 |
| 3,828,864 | 8/1974 | Haverkamp et al. | 173/49 |
| 3,868,859 | 5/1975 | Scerbo | 74/61 |

FOREIGN PATENT DOCUMENTS

| | | | |
|---|---|---|---|
| 81,820 | 6/1956 | Netherlands | 173/49 |

*Primary Examiner*—Lawrence J. Staab
*Attorney, Agent, or Firm*—Samuelson & Jacob

[57] ABSTRACT

A machine for driving and extracting piling and the like having a horizontal support member and frame coupled so that the frame may move toward and away from the support member in a vertical direction, a pair of races located side by side in the frame and defining a corresponding pair of paths of travel spaced horizontally from each other and located in a common vertical plane, a relatively heavily weighted roller mounted for rotation within each race, each roller being rotatable about a horizontal axis perpendicular to the common vertical plane, means for rotating the weighted rollers in synchronism such that the horizontal components of the forces generated on the frame by the rollers cancel one another and the vertical components of the forces are in phase to thereby simulate the impact of a conventional reciprocating pile hammer.

12 Claims, 8 Drawing Figures

MACHINE SUSPENDED FROM A CRANE OR SIMILAR DEVICE FOR DRIVING AND EXTRACTING PILING AND THE LIKE

The invention relates to machines which are suspended from a crane or a similar device for driving and extracting piles or the like. In particular, the invention is directed toward providing a rotational driver utilizing rotating weights whose horizontal components of force are out of phase and whose vertical components are in phase to thereby maximize the force applied to the pile, whether driving or extracting.

At present the installation of pilings is accomplished in several ways. The most accepted method for the installation of bearing piles utilizes an impact hammer which delivers a known energy to the head of the pile. The bearing capacity of the pile is determined from standard formulas and depends upon the known energy of the hammer and the measured set of the pile per blow. Since the integrity of the structure founded on the piles is directly dependent on the ability of the piling to carry the design loads, the dynamic testing by blow count and by well-proven formulas is always used to determine when the pile has achieved the required bearing capacity. The most widely accepted bearing pile hammer is the single acting type because the energy output is constant and completely predictable. The ram of a known mass is raised to a known height and upon freely falling from that height it delivers a known energy to the pile. The pile set is then measured and the bearing capacity is determined.

Frequently, other types of hammers are used for driving and extracting piles. All these other types have some inherent variables which make it difficult and often impossible to determine the bearing capacity of the pile. Some of these variables are varying pressures being used to move the ram, pre-compression and combustion, etc. However, these other types of hammers are used because they can usually deliver many more blows per minute to the pile than can be delivered by a pure single acting hammer.

These other types of hammers are certainly of value when driving piles under conditions in which the bearing capacity is not important. Examples of such conditions are the installation of H-beams, sheet piling for bulkheads, trench shoring, coffer dams, etc. In recent years, another type of hammer has come into use for these jobs in which the pile's bearing capacity is not critical. This type hammer is known as the vibratory driver. Usually, the vibratory driver consists of synchronized rotating weights which rotate in opposite directions to develop a linear force in phase in one direction and out of phase linear forces in the direction in quadrature with the in-phase direction. The unit is attached to the pile and vertical, linear, vibratory motion is transmitted thereto. However, the pile movement compared to that produced by an impact hammer is very small, of the order of ¼ to ½ inch. As a consequence, these vibratory drivers work well in only certain soils and, for all practical purposes, will not penetrate through any obstructions.

When a piling contractor has a job which may be done with a vibratory driver, he rents one of them so that he can actually try it in the field. If the soil is such that it will react properly to the high speed, low amplitude characteristics of the machine, it is often used on that job. Moreover, its use is inhibited if the ground has many obstructions which impede and frequently completely stop entry of the pile into the ground. However, if conditions are right, the increased cost of the equipment is offset by the increase in the speed of the job completion when compared to that obtained from an impact type machine.

The vibratory drivers actually vibrate the pile in the earth and that vibration coupled with the very small amplitude downward thrust on the pile serves to drive the pile into the ground. The driving speed of such a vibratory driver compared to that of an impact hammer in soils ideal for the use of the vibratory device is spectacular. The advantage runs as high as 20 to 1. However, soil content, consistency and composition may vary considerably on the same construction site and the presently used vibratory drivers frequently cannot be used throughout the site.

For example, the soil at one location on the site may respond best to a frequency of 1800 cycles per minute (cpm) and an amplitude of ¼ inch and the soil at a location a few hundred feet away may respond best to a frequency of 500 to 700 cpm and an amplitude of ½ inch or more. Present day vibratory drivers do not permit the user to make such changes in the machine's parameters. One such machine is adjustable between 750 cpm and 1050 cpm. Another is adjustable between 1500 cpm and 1800 cpm. In either case, the frequency adjustments are time consuming and often fruitless.

As a result, contractors are burdened with reduced production and increased cost. Frequently, for a myriad of reasons, the contractor abandons the use of the vibratory driver and returns to the slower, more reliable impact hammer. Moreover, the cost of manufacturing the present day vibratory drivers is very high. The manufacturing tolerances are very close since the fit and alignment of the bearings and shafts are very critical and the bearings must take tremendous eccentric shock loads.

These present day vibratory drivers require very high starting torque and horsepower (HP). For example, one requires a 200–250 HP motor for a 100,000 lb. force, vibratory. The full power is needed to start the eccentrics. Once the eccentrics are turning, the power drive requirement drops to the order of 50–60 HP. The drive for a vibratory device, just described, amounts to about one quarter of the total cost of the driver. Once one weighs cost against results, many contractors continue to use proven devices and methods even for sheet pile and other non-bearing piling installations.

Under ideal soil conditions, vibratory devices have been used to install bearing piles. However, the final few feet of penetration must be done with a conventional impact hammer in order to determine the bearing capacity of the pile.

Accordingly, it is an important object of the invention to provide a rotational driver with the speed advantages of vibratory drivers and the amplitude advantages of impact hammers.

It is another object of the invention to provide such a rotational driver whose rotational speed and drive amplitude may be varied over very wide ranges.

It is a further object of the invention to provide such a driver whose cost of manufacture is lower and whose construction does not require that critical tolerances be held.

It is yet another object of the invention to provide such a driver with means to reduce the need for high starting torques and high starting power.

It is yet another object of the invention to provide a vertical amplitude of movement of the order of 4 inches for each rotation of the weights.

It is a still further object of the invention to provide a combined rotational driver and impact hammer to enable one to accomplish high amplitude, rapid driving in all soils with the rotational driver and to test the final bearing capacity with several blows from the impact, single-acting hammer.

It is a still further object of the invention to permit one to switch easily from the rotational driver to the impact hammer.

These and other objects, advantages, features and uses will become apparent during the course of the following description when taken together with the accompanying drawing.

Broadly, the rotational driver of the invention comprises a pair of races located side by side in a common vertical plane in a frame which is suspended below a horizontal support member such that it may move vertically with respect to the horizontal support member. The horizontal support member is suspended from a crane or similar device.

A relatively heavily weighted roller is mounted for rotation within each race, each roller is rotatable about a horizontal axis perpendicular to the common vertical plane. Means for rotating the relatively heavily weighted rollers is provided to rotate the rollers in synchronism along corresponding paths of travel such that the rollers generate horizontal components of force which are out of phase and cancel each other and the rollers generate vertical components of force which are in phase and are additive. The vertical forces thus produced are alternately upward and downward to thereby simulate the impact of a conventional reciprocating pile hammer.

Means are provided for selectively retracting radially each roller to shorten the radius of movement of the rollers and thereby reduce the torque and horsepower required for starting the driver.

Means are also provided for selectively changing the relative vertical position of each horizontal axis relative to its associated race to thereby adjust the magnitude of the upward and downnward forces.

In the accompanying drawing, forming a part of this application, in which like numerals designate like parts throughout the same:

Figure 1:
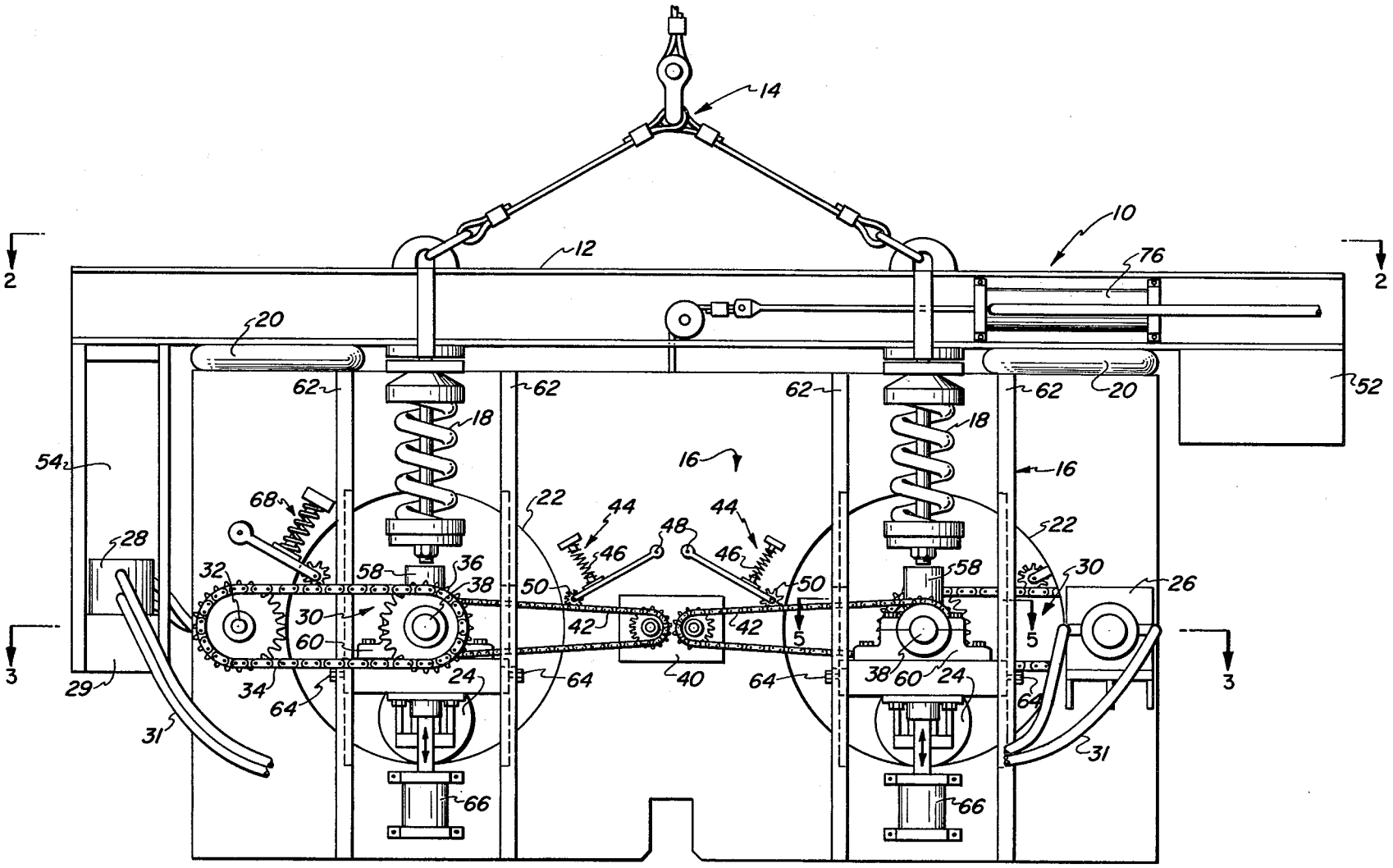
FIG. 1 is an elevational view of a preferred embodiment of the invention.
Figure 2:
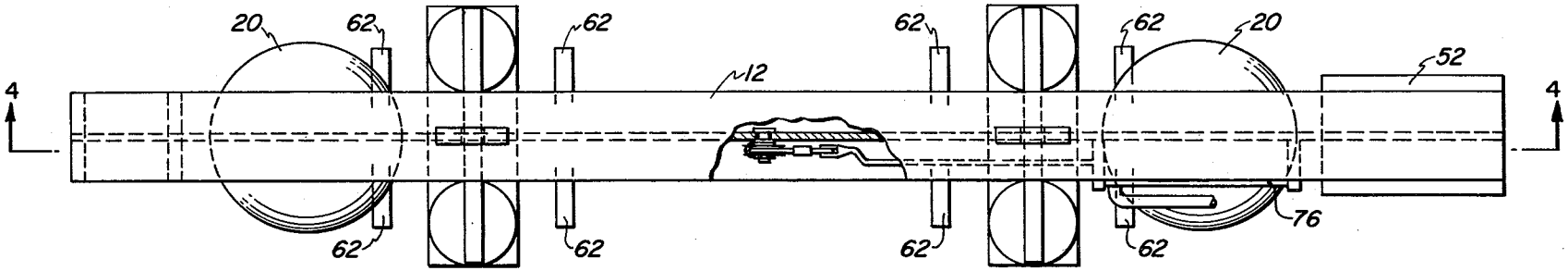
FIG. 2 is a horizontal top view, viewed in the direction of arrow 2 of FIG. 1.
Figure 3:
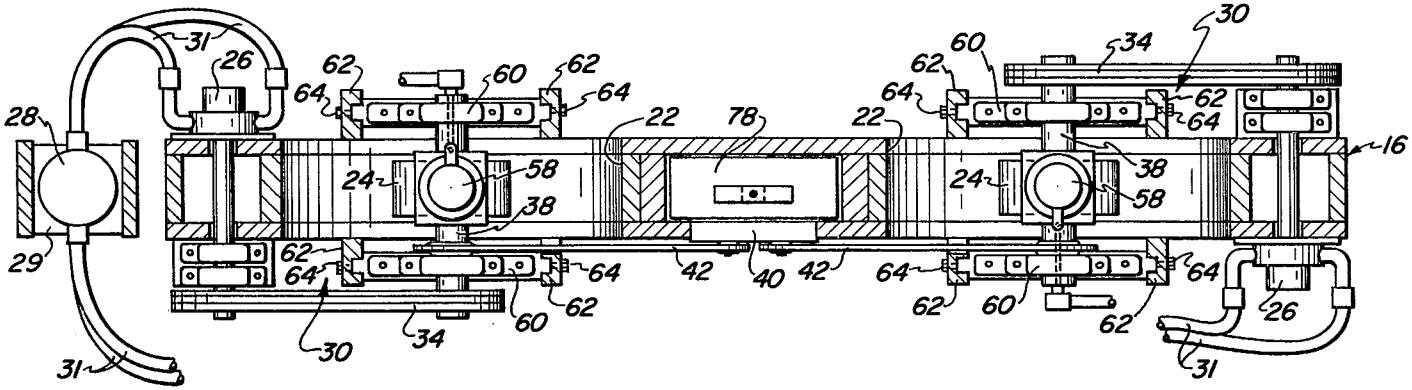
FIG. 3 is a sectional view taken on lines 3—3 of FIG. 1, viewed in the direction of the arrows.
Figure 4:
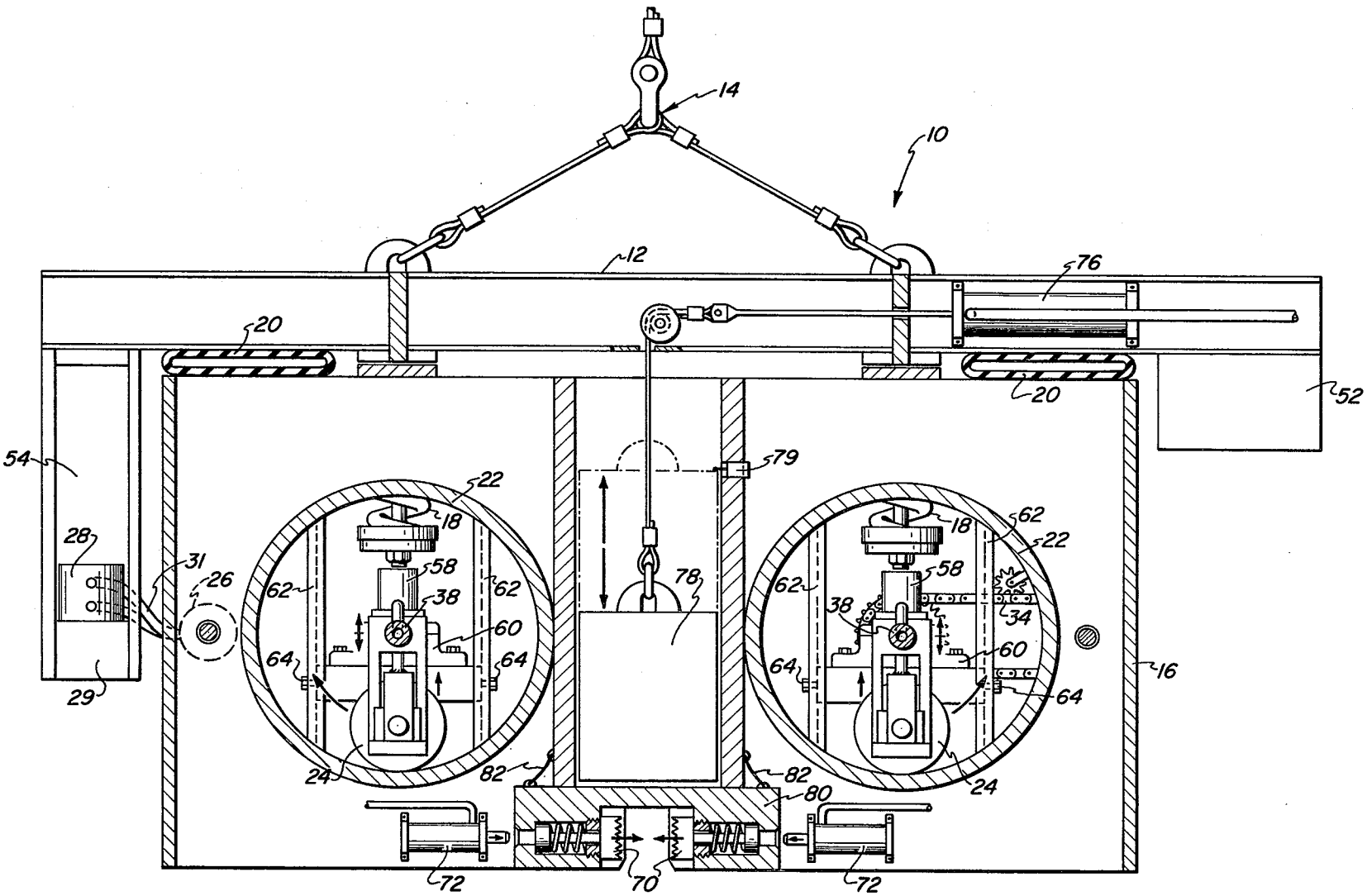
FIG. 4 is a sectional view taken on lines 4—4 of FIG. 2, viewed in the direction of the arrows.

In the drawing, wherein, for the purpose of illustration, is shown a preferred embodiment of the invention, the numeral 10 designates a rotational driver of the invention, generally. Rotational driver 10 is seen to comprise a horizontal support member 12 which is connected to be suspended from a crane or similar device (not shown) by means of cable system 14. A frame 16 is suspended from the horizontal support member 12 by suspension means preferably in the form of two pairs of helical springs 18 and a pair of sealed air bags 20.

A pair of races 22 are mounted side by side in frame 16. The races 22 are spaced horizontally from each other and are located in a common vertical plane. There is a relatively heavily weighted roller 24 mounted for rotation in each race. Preferably, each roller has a mass of at least about 200 lbs. Satisfactory results are obtained when the mass of each roller is of the order of between about 200 lbs. and about 1000 lbs. and the diameter of each race is of the order of 24 to 72 inches.

In order to drive the weights there is provided a pair of fluid motors 26, there being one such motor associated with each roller 24. The fluid motors 26 are supplied by fluid pump 28 which is actuated by an electric motor 29. The fluid pump 28 is coupled to the motors 26 by flexible conduits 31. Each fluid motor 26 is coupled to the associated weighted roller by a chain and sprocket assembly 30. The chain and sprocket assembly 30 comprises a drive sprocket 32 which is connected to the motor, a chain 34 and a driven sprocket 36. The driven sprocket 36 is mounted on a shaft 38 in common with the support of the weighted roller 24, the details of which will be discussed later. To achieve the synchronized rotation of the rollers as required to practice the invention, synchronizing means 40 is connected to each shaft 38 by means of a pair of chains 42. Each of these chains 42 is connected to a gear (not shown) in the synchronizing means 40. The two gears are meshed together and thereby serve to hold the two rotating weighted rollers in synchronism.

A pair of tensioning means 44 is mounted to frame 16, there being one tensioning means 44 for each chain 42. Each tensioning means 44 serves to take up the slack in its associated chain 42. In a preferred form, the tensioning means comprises a spring 46 in compression, a pivot 48 and a movable roller 50 which is pressed against the chain 42. To keep horizontal support member 12 substantially horizontal and fixed during use, a weight 52 is mounted at one end thereof to balance the mass 54 at the other end.

Each weighted roller 24 is mounted on an axle 25 which rotates in a ball bearing 27 which is mounted in a block 57. Block 57 is welded to yoke 56 which slides with respect to an arm 55 which is mounted for rotation with shaft 38. Since the weighted rollers 24 are quite heavy, it would normally be necessary to use a high powered prime mover to deliver high torque to start rotation of the weights. However, the invention permits the use of a much smaller motor because of a novel feature incorporated in the machine. A hydraulic cylinder 58 is connected to each yoke 56 so that when fluid is pumped into the cylinder 58, the weighted roller 24 is pulled upward off the race 22. The radius of rotation is thereby shortened so that less torque is required for starting. Moreover, since fluid motors 26 are readily reversible, it is possible to rock the weighted rollers on starting to further reduce the amount of required starting torque. Once the machine is operating, the fluid is removed from the cylinder 58 and the roller will follow the race.

Figure 5:
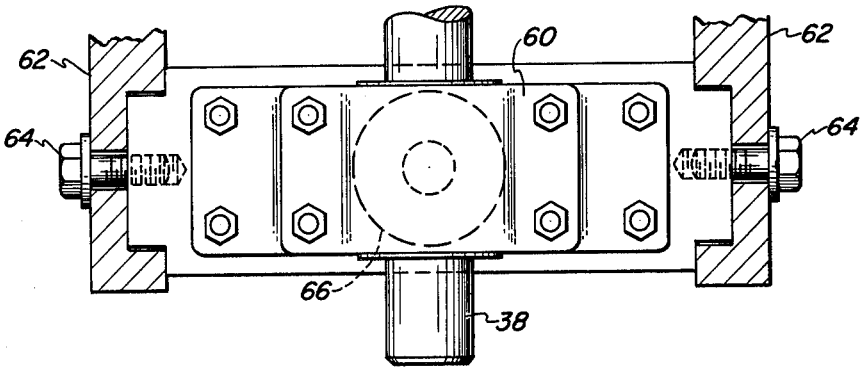
FIG. 5 is an enlarged sectional view taken on lines 5—5 of FIG. 1, viewed in the direction of the arrows.
Figure 7:
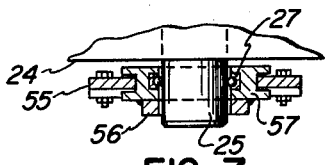
FIG. 7 is a sectional view taken on lines 7—7 of FIG. 6, viewed in the direction of the arrows.
Figure 6:
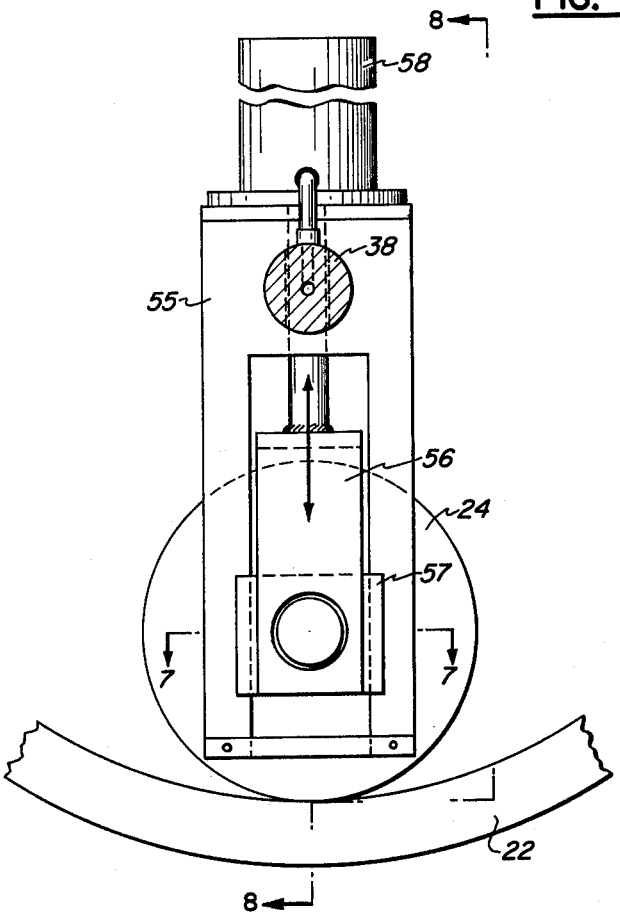
FIG. 6 is an enlarged, fragmentary elevational view of a weighted roller of the invention.
Figure 8:
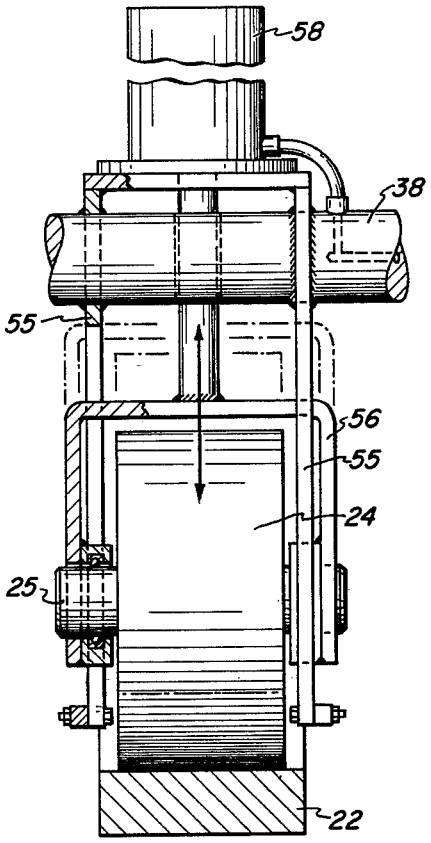
FIG. 8 is an elevational view, viewed in the direction of arrow 8 of FIG. 6.

Since it is desirable to be able to maximize the direction of the vertical force, namely, downward when driving and upward when extracting, it has been found advantageous to be able to change the positions of the axes of rotation of each shaft 38. It can be seen in FIG. 5 that the blocks 60 below the shafts 38 are held in rails 62 by means of bolts 64. In order to increase the downward force, the shaft 38 should be as far as possible from the bottom of race 22. Conversely, to increase the upward force, the shaft 38 should be as far as possible from the top of race 22.

To accomplish this adjustment for maximum downward force, the bolts 64 are loosened and fluid is pumped into cylinders 66 to raise the shaft 38 to its desired position. The bolts 64 are now tightened in the new position. The roller is now free to follow the race. Tensioning means 68 similar to tensioning means 44 are used to keep chains 34 properly tensioned regardless of the position of shaft 38 or roller 24. When it is desirable to lower the shaft 38 to achieve maximum upward force, the bolts 64 are loosened and fluid is exhausted from cylinders 66 until the desired position is reached. The bolts 64 are now tightened and the rollers are ready for rotation.

When driving piles with the rotational driver, the pile is held in jaws 70 which are closed and opened by means of hydraulic cylinders 72. The jaws are also used to grip the pile when extracting it. During driving or extracting the frame 16 moves with respect to horizontal support member 12. After the pile has reached close to its desired depth and bearing capacity, it is released from the jaws 70, if desired. Now, the operator shuts off the rotational driver and opens the suitable valves (not shown) for feeding fluid into a cylinder 76. This raises a hammer 78 and when hammer 78 contacts a switch 79, the fluid is exhausted from cylinder 76 (details not shown) and hammer 78 drops. Thus, the hammer 78 drops through a known distance against an anvil 80 for final driving and/or the testing of bearing capacity. Anvil 80 is loosely strapped to frame 16 by wire rope straps 82 which allow the anvil 80 to move with respect to the frame 16 but preclude its dropping free of the frame 16.

Since large amplitudes of force are desired for maximum utilization of the rotational driver of the invention, namely, from about 1 to about 5 inches, it is necessary to rotate the rollers 24 at fairly low speeds, namely of the order from about 50 to about 800 revolutions per minute. The amplitude of the vertical movement achieved is a function of the weight of the rollers and the velocity of rotation of the rollers.

In a driving operation, the driver 10 is suspended from a crane or similar device and the top of a pile is affixed in the jaws 70. As the pile is driven down by the rotation of the rollers, the crane lowers the driver 10 so that the pile is always in driving contact with the soil.

In an extracting operation, the pile is caught in the jaws 70 and the crane raises the driver 10 as the pile is loosened in the earth.

While a particular embodiment of the invention has been shown and described, it is apparent to those skilled in the art that modifications are possible without departing from the spirit of the invention or the scope of the subjoined claims.

The embodiments of the invention in which an exclusive property or privilege is claimed are defined as follows:

1. A machine for being suspended from a crane, or a similar device, for driving and extracting piling and the like with forces which simulate the impact obtained with a conventional reciprocating pile hammer, said machine comprising:

a horizontal support member;

a frame below the horizontal support member;

suspension means coupling the horizontal support member and the frame for permitting vertical movement of the frame toward and away from the horizontal support member;

a pair of races located side by side in the frame and defining a corresponding pair of paths of travel spaced horizontally from one another and located in a common vertical plane, the races being circular and each having a diameter of about 24 inches to about 72 inches;

a heavily weighted roller mounted for rotation within each race, each roller weighing between about 200 pounds and about 1000 pounds and being rotatable about a horizontal axis perpendicular to the common vertical plane;

means for rotating the weighted rollers in synchronism at a low rate of rotation to move each roller along a corresponding path of travel whereby the rollers will generate forces upon the frame, the rate of rotation being about 50 to about 800 revolutions per minute and the synchronism being such that the horizontal components of the forces are in opposite directions and cancel one another, while the vertical components of the forces are in the same direction and establish alternating upward and downward forces which simulate the impact of a conventional reciprocating pile hammer;

the horizontal support member being weighted so as to tend to remain stationary while the frame is displaced vertically relative to the support member in response to rotation of the weighted rollers; and the suspension means including resilient means enabling vertical displacement of the frame relative to the support member in the range of about 1 inch to about 5 inches.

2. The invention of claim 1 wherein the means for rotating the weighted rollers includes a fluid motor coupled to each roller and a fluid pump for driving the fluid motors.

3. The invention of claim 2 wherein the means for rotating the weighted rollers includes synchronizing means coupling one roller to the other for synchronizing the rotation of the rollers.

4. The invention of claim 2 wherein the fluid pump is mounted upon the support member, the fluid motors are mounted upon the frame and flexible conduits connect the fluid pump with the fluid motors.

5. A machine for being suspended from a crane, or a similar device, for driving and extracting piling and the like with forces which simulate the impact obtained with a conventional reciprocating pile hammer, said machine comprising:

a horizontal support member;

a frame below the horizontal support member;

suspension means coupling the horizontal support member and the frame for permitting vertical movement of the frame toward and away from the horizontal support member;

a pair of races located side by side in the frame and defining a corresponding pair of paths of travel spaced horizontally from one another and located in a common vertical plane;

a relatively heavily weighted roller mounted for rotation within each race, each roller being rotatable about a horizontal axis perpendicular to the common vertical plane;

means for rotating the weighted rollers in synchronism at a relatively low rate of rotation to move each roller along a corresponding path of travel whereby the rollers will generate forces upon the frame, the synchronism being such that the horizontal components of the forces are in opposite directions and cancel one another, while the vertical components of the forces are in the same direction and establish alternating upward and downward forces which simulate the impact of a conventional reciprocating pile hammer;

a radial arm journaled for rotation upon the frame within each race, with a corresponding roller being carried by the radial arm, adjacent the outer end of the radial arm, as each roller travels within the corresponding race; and means on each radial arm for selectively retracting radially the roller carried by the arm to selectively shorten the radius of movement of each roller.

6. The invention of claim 5 wherein the means on each radial arm for selectively retracting the roller includes fluid actuated means capable of operation during rotation of the radial arm.

7. A machine for being suspended from a crane, or a similar device, for driving and extracting piling and the like with forces which simulate the impact obtained with a conventional reciprocating pile hammer, said machine comprising:

a horizontal support member;

a frame below the horizontal support member;

suspension means coupling the horizontal support member and the frame for permitting vertical movement of the frame toward and away from the horizontal support member;

a pair of races located side by side in the frame and defining a corresponding pair of paths of travel spaced horizontally from one another and located in a common vertical plane;

a relatively heavily weighted roller mounted for rotation within each race, each roller being rotatable about a horizontal axis perpendicular to the common vertical plane;

means for rotating the weighted rollers in synchronism at a relatively low rate of rotation to move each roller along a corresponding path of travel whereby the rollers will generate forces upon the frame, the synchronism being such that the horizontal components of the forces are in opposite directions and cancel one another, while the vertical components of the forces are in the same direction and establish alternating upward and downward forces which simulate the impact of a conventional reciprocating pile hammer; and means for selectively changing the relative vertical position of each horizontal axis relative to the corresponding race to adjust the relative magnitude of the upward and downward forces.

8. The invention of claim 7 wherein the means for selectively changing the relative vertical position of each horizontal axis relative to the corresponding race includes means for selectively moving each horizontal axis vertically relative to the corresponding race.

9. The invention of claim 8 including:

a radial arm journaled for rotation upon the frame within each race, with a corresponding roller being carried by the radial arm, adjacent the outer end of the radial arm, as each roller travels within the corresponding race; and means on each radial arm for enabling the roller to follow the corresponding path of travel at any selected position of the corresponding horizontal axis relative to the race.

10. A machine for being suspended from a crane, or a similar device, for driving and extracting piling and the like with forces which simulate the impact obtained with a conventional reciprocating pile hammer, said machine comprising:

a horizontal support member;

a frame below the horizontal support member;

suspension means coupling the horizontal support member and the frame for permitting vertical movement of the frame toward and away from the horizontal support member;

a pair of races located side by side in the frame and defining a corresponding pair of paths of travel spaced horizontally from one another and located in a common vertical plane;

a relatively heavily weighted roller mounted for rotation within each race, each roller being rotatable about a horizontal axis perpendicular to the common vertical plane;

means for rotating the weighted rollers in synchronism at a relatively low rate of rotation to move each roller along a corresponding path of travel whereby the rollers will generate forces upon the frame, the synchronism being such that the horizontal components of the forces are in opposite directions and cancel one another, while the vertical components of the forces are in the same direction and establish alternating upward and downward forces which simulate the impact of a conventional reciprocating pile hammer;

an anvil carried by the frame;

a hammer mounted in the frame above the anvil for vertical reciprocating movement toward and away from the anvil; and means for selectively raising the hammer to a predetermined height above the anvil and then allowing the hammer to fall against the anvil.

11. The invention of claim 10 wherein the anvil is free to move relative to the frame in response to the fall of the hammer.

12. The invention of claim 11 wherein the hammer is located between the races.

* * * * *